US005892209A

United States Patent [19]

Choi

[11] Patent Number: 5,892,209

[45] Date of Patent: Apr. 6, 1999

[54] MICROWAVE OVEN HAVING AN IMPROVED DRAIN STRUCTURE

[75] Inventor: Jung-mook Choi, Suwon, Rep. of Korea

[73] Assignee: Samsung Electronics Co., Ltd., Suwon, Rep. of Korea

[21] Appl. No.: 19,691

[22] Filed: Feb. 6, 1998

[30] Foreign Application Priority Data

Nov. 14, 1997 [KP] DPR of Korea ..... 1997-60014

[51] Int. Cl.[6] ..... B65D 25/10

[52] U.S. Cl. ..... 219/754

[58] Field of Search ..... 219/733, 754, 219/755, 752, 753, 756

[56] References Cited

U.S. PATENT DOCUMENTS

| | | | |
|---|---|---|---|
| 4,036,151 | 7/1977 | Shin et al. | 108/20 |
| 4,283,614 | 8/1981 | Tanaka et al. | 219/754 |
| 4,490,923 | 1/1985 | Thomas et al. | 34/1 |
| 5,155,318 | 10/1992 | Bowen . | |
| 5,216,216 | 6/1993 | Kim et al. | 219/754 |

FOREIGN PATENT DOCUMENTS

| | | |
|---|---|---|
| 3-241690 | 10/1991 | Japan . |
| 4-188595 | 7/1992 | Japan . |
| 90-2167 | 3/1990 | Rep. of Korea . |
| 94-3746 | 6/1994 | Rep. of Korea . |

*Primary Examiner*—Teresa Walberg
*Assistant Examiner*—Jeffrey Pwu
*Attorney, Agent, or Firm*—Burns, Doane, Swecker & Mathis, L.L.P.

[57] ABSTRACT

A microwave oven having an improved draining structure. The microwave oven has a turn table installed at an inner lower portion of a cooking chamber; a roller assembly disposed in a water collecting portion formed at the bottom plate of the cooking chamber so as to support the turn table against a bottom plate of the cooking chamber; a motor bracket attached at an underside of the bottom plate; a motor installed at an underside of the motor bracket; and a coupler for transmitting a driving force of the motor to the turn table. A water collecting groove having at least one first draining hole is formed at the water collecting portion of the bottom plate of the cooking chamber. A downwardly inclined portion for preventing a water dropped from the first draining hole from flowing into the motor is provided at the motor bracket below the first draining hole. At least one second draining hole is formed at an end of the downwardly inclined portion of the motor bracket.

4 Claims, 3 Drawing Sheets

MICROWAVE OVEN HAVING AN IMPROVED DRAIN STRUCTURE

BACKGROUND OF THE INVENTION

1. Field of the Invention

The present invention relates to a microwave oven, and more particularly to a microwave oven having a turn table which is disposed at an inner lower portion of a cooking chamber and is driven by a motor.

2. Prior Arts

Generally, in a microwave oven, foods to be cooked are heated by microwaves generated from a magnetron. When foods received in a vessel are heated in a cooking chamber of the microwave oven, water being boiled in the vessel may overflow from the vessel to the bottom of the cooking chamber. If the overflowed water flows into a motor for driving a turn table, an electrical short of the motor can be occurred thereby causing a malfunction of the microwave oven.

In order to overcome the above problem, various types of microwave ovens are suggested. For example, a microwave oven having a drain structure is disclosed in Korea Utility Model Publication No. 94-3746. FIG. 1 shows the microwave oven disclosed in Korea Utility Model Publication No. 94-3746. As shown in FIG. 1, the conventional microwave oven 100 has a turn table 102 installed at an inner lower portion of a cooking chamber 101 and a water collecting portion 104 formed at a bottom plate 103 of cooking chamber 102. A roller assembly 105 for supporting turn table 102 against bottom plate 103 of cooking chamber 101 is provided in water collecting portion 104.

A motor bracket 106 is attached at an underside of bottom plate 103, and a motor 107 is installed at an underside of motor bracket 106. At a center of bottom plate 103, there is formed an opening 103*a* into which a coupler 108 for connecting turn table 102 to a motor shaft 107*a* is inserted. The driving force of motor 107 is transmitted to turn table 102 through coupler 108.

A motor shaft inserting hole 108*a* is formed at an underside of coupler 108, and an inclined portion 108*b* is formed at an inner circumference portion of motor shaft inserting hole 108*a*, as shown in FIG. 1A. In order to prevent coupler 108 from separating from bottom plate 103, a projection 108*c* is provided at an upper portion of coupler 108.

A bottom plate 106*a* of motor bracket 106 is formed at its one side with a downwardly inclined portion 106*b*, and a plurality of draining holes 106*c* is formed at an end portion of downwardly inclined portion 106*b*. In addition, at a center portion of the underside of motor bracket 106, there is formed an upwardly inclined portion 106*d* which extends into an inner portion of inclined portion 108*b*.

In the conventional microwave oven constructed as mentioned above, even when water W overflowed from the vessel flows along an outer surface of coupler 108, upwardly inclined portion 106*d* formed at the center of motor bracket 106 can prevent the overflowed water from flowing into motor 107. Overflowed water W flows along downwardly inclined portion 106*b* of motor bracket 106 and is draining out of microwave oven 100 through draining hole 106*c*.

However, conventional microwave oven 100 has no any device for draining water W remaining in water collecting portion 104, so water W, which is overflowed from the vessel and is collected in water collecting portion 104 during cooking operation, is draining toward coupler 108 only when the level of water W in water collecting portion 104 exceeds the capacity of water collecting portion 104.

That is, overflowed water W is still remaining in water collecting portion 104 if the user does not remove overflowed water W from water collecting portion 104. The remaining water is rotten as time goes by, thereby contaminating cooking chamber 101.

SUMMARY OF THE INVENTION

The present invention has been made to overcome the above described problem of the prior art, and accordingly, it is an object of the present invention to provide a microwave oven having an improved draining structure by which water overflowed from a vessel during the cooking operation is not remaining in a bottom portion of a cooking chamber, but rapidly draining out of the microwave oven.

To achieve the above object, the present invention provides a microwave oven comprising: a turn table installed at an inner lower portion of a cooking chamber; a roller assembly for supporting the turn table against a bottom plate of the cooking chamber, the roller assembly being disposed in a water collecting portion formed at the bottom plate of the cooking chamber; a motor bracket attached at an underside of the bottom plate; a motor installed at an underside of the motor bracket; and a coupler for transmitting a driving force of the motor to the turn table, wherein a water collecting groove having at least one first draining hole is formed at the water collecting portion of the bottom plate of the cooking chamber, a downwardly inclined portion for preventing a water dropped from the first draining hole from flowing into the motor is provided at the motor bracket below the first draining hole, and at least one second draining hole is formed at an end of the downwardly inclined portion of the motor bracket.

According to the present invention, the overflowed water flowing into the water collecting portion formed at the bottom plate of the cooking chamber is draining out of the cooking chamber through the first draining hole of the water collecting groove formed at the water collecting portion, so water overflowed from the vessel during the cooking operation is not remaining at the bottom of the cooking chamber, but rapidly draining out of the microwave oven.

BRIEF DESCRIPTION OF THE DRAWINGS

The above object and other advantages of the present invention will become more apparent by describing in detail a preferred embodiment with reference to the attached drawings, in which.

DESCRIPTION OF THE PREFERRED EMBODIMENT

Figure 1:
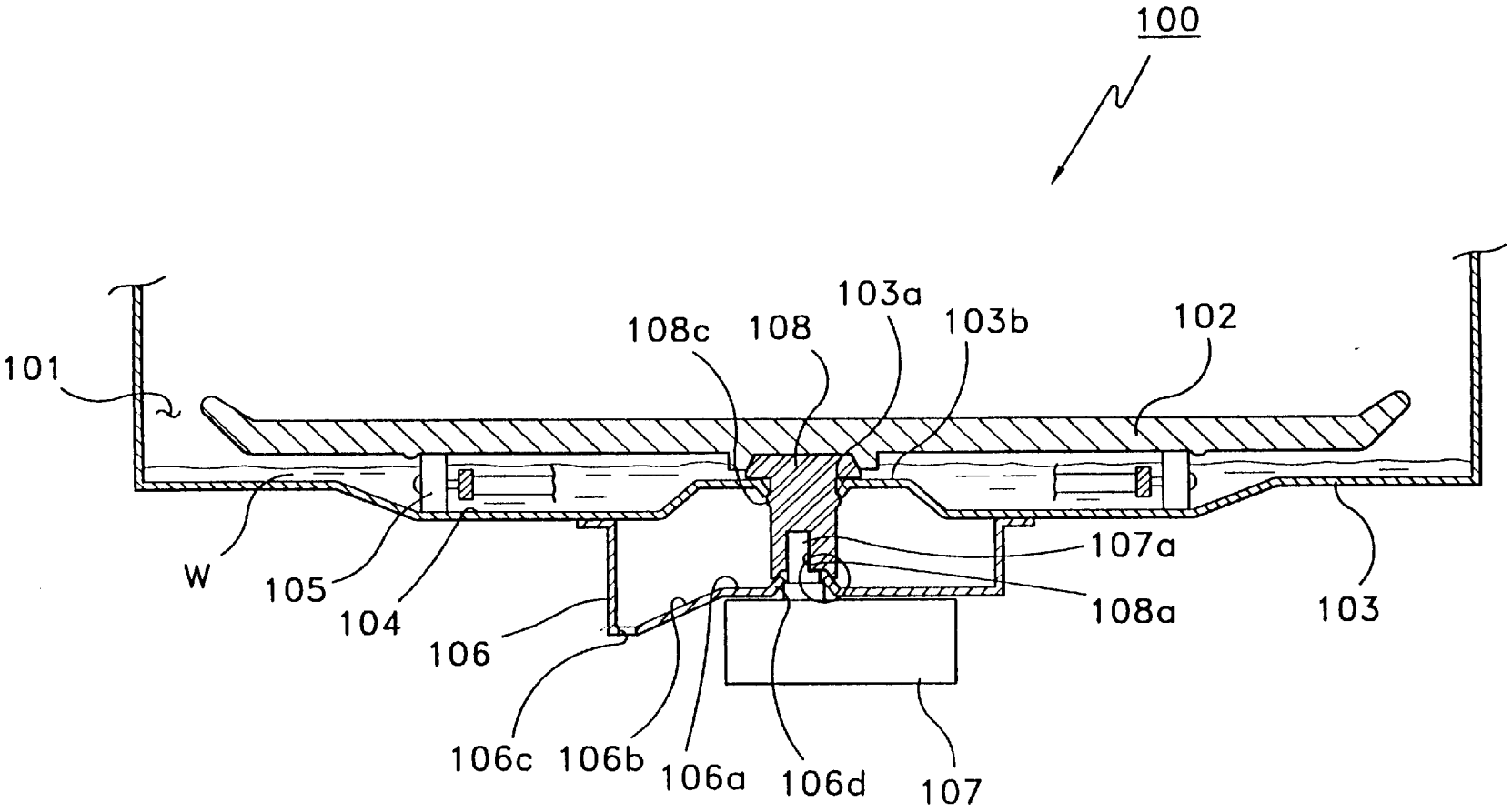
FIG. 1 (PRIOR ART)
FIG. 1 is a sectional view showing a microwave oven having a conventional draining structure.
Figure 1A:
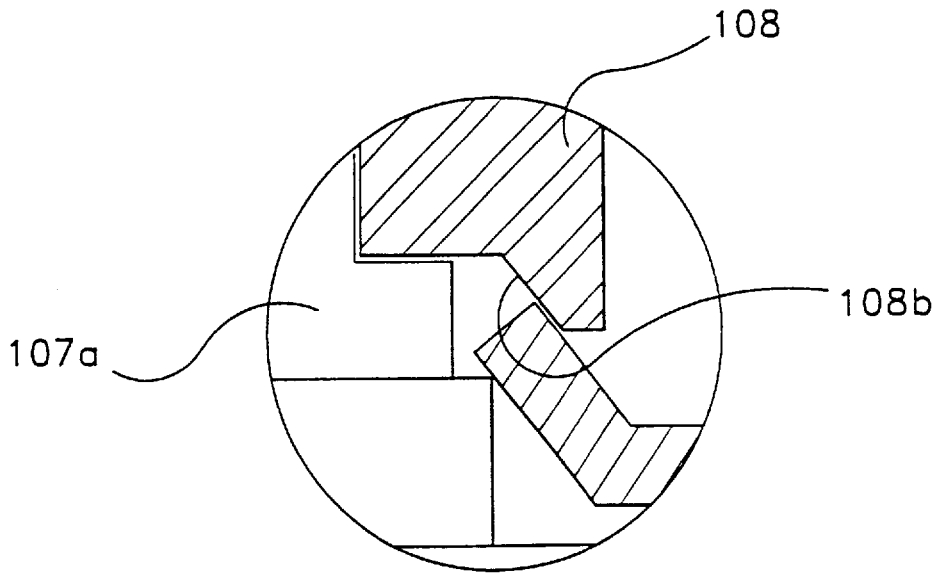
FIG. 1A (PRIOR ART)
FIG. 1A is an enlarged view of an encircled fragment of FIG. 1.
Figure 2:
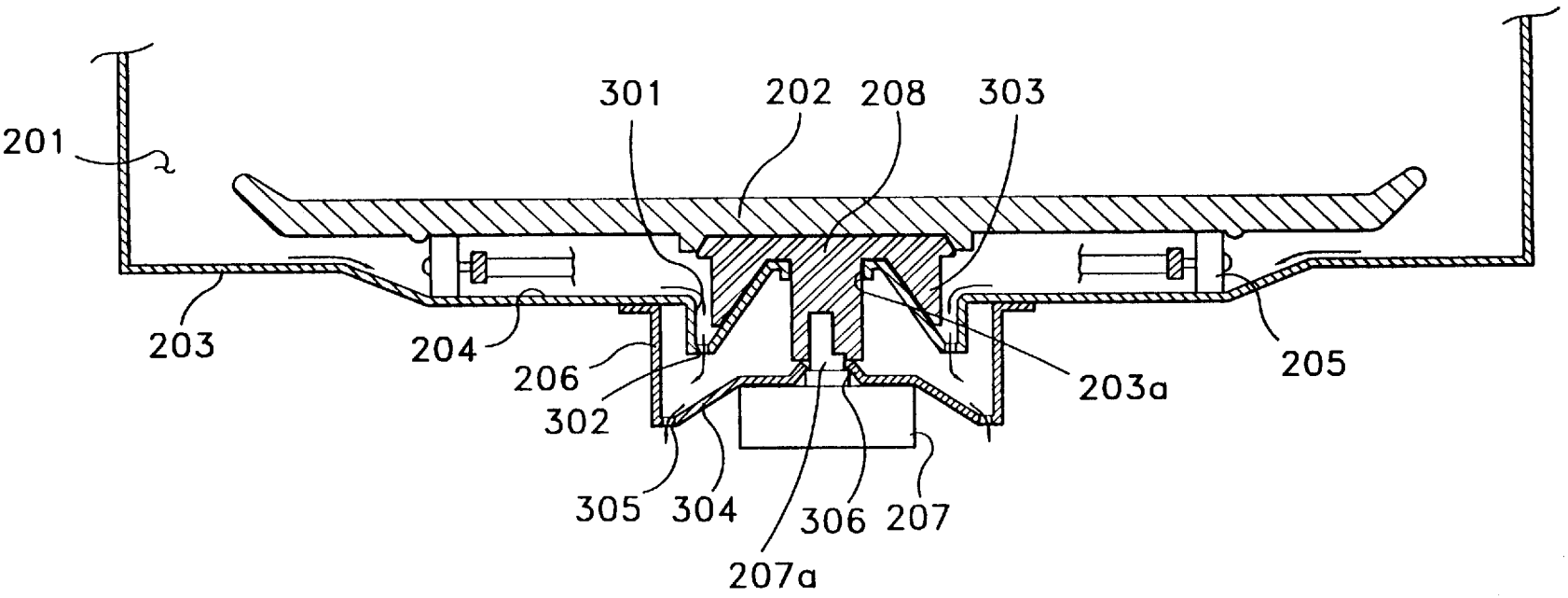
FIG. 2 is a sectional view showing a microwave oven having a draining structure according to the present invention.

FIG. 2 shows a microwave oven having an improved draining structure according to the present invention. As shown in FIG. 2, the microwave oven of the present invention has a turn table 202 installed at an inner lower portion of a cooking chamber 201 and a water collecting portion 204 formed at a bottom plate 203 of cooking chamber 202. A roller assembly 205 for supporting turn table 202 against bottom plate 203 of cooking chamber 201 is provided in water collecting portion 204.

A motor bracket 206 is attached at an underside of bottom plate 203, and a motor 207 is installed at an underside of motor bracket 206. At a center of bottom plate 203, there is formed an opening 203*a* into which a coupler 208 for connecting turn table 202 with a motor shaft 207*a* is inserted. The driving force of motor 207 is transmitted to turn table 202 through coupler 208.

Water collecting portion 204 of bottom plate 204 is formed with an annular groove 301 for collecting water, and annular groove 301 is formed at its underside with a plurality of draining holes 302. Coupler 208 is provided with a projection 303 which downwardly extends toward an inner portion of annular groove 301. An inner surface of projection 303 closely makes contact with a radially inward wall of annular groove 301 so that water W collected in annular groove 301 cannot leak into motor 207 therethrough.

At a predetermined portion of motor bracket 206 below first draining holes 302, there is formed a downwardly inclined portion 304 which prevents water W dropped from first draining holes 302 from flowing into motor 207. Downwardly inclined portion 304 of motor bracket 206 is formed at an end thereof with a plurality of second draining holes 305.

In addition, an upwardly inclined portion 306 is provided at a predetermined portion of motor bracket 206 into which motor shaft 207*a* passes through. Upwardly inclined portion 306 prevents water W dropped into motor bracket 206 from flowing into motor 207.

In the microwave oven constructed as described above, as indicated by arrows in FIG. 2, overflowed water W flowing into water collecting portion 204 formed at bottom plate 203 of cooking chamber 201 is collected in annular groove 301 of water collecting portion 204.

Water W collected in annular groove 301 is discharged out of cooking chamber 201 through first draining holes 302 formed at annular groove 301, and then is dropped into motor bracket 206.

Water W dropped into motor bracket 206 flows along downwardly inclined portion 304 of motor bracket 206, and is draining out of the microwave oven through second draining holes 305 formed at the end of downwardly inclined portion 304.

As a result, according to the present invention, the overflowed water flowing into water collecting portion 204 formed at bottom plate 203 of cooking chamber 201 is draining out of cooking chamber 201 through first draining hole 302 of annular groove 301 formed at water collecting portion 201, so water W overflowed from the vessel during the cooking operation is not remaining at the bottom of cooking chamber 201, but rapidly draining out of the microwave oven.

Accordingly, the life span of the motor can be expanded, a malfunction of the microwave oven can be reduced, and the microwave oven can be reliably operated.

While the present invention has been particularly shown and described with reference to a preferred embodiment thereof, it will be understood by those skilled in the art that various changes in form and detail may be effected therein without departing from the spirit and scope of the invention as defined by the appended claims.

What is claimed is:

1. A microwave oven comprising:

a turn table installed at an inner lower portion of a cooking chamber;

a roller assembly for supporting the turn table against a bottom plate of the cooking chamber, the roller assembly being disposed in a water collecting portion formed at the bottom plate of the cooking chamber;

a motor bracket attached at an underside of the bottom plate;

a motor installed at an underside of the motor bracket; and a coupler for transmitting a driving force of the motor to the turn table, wherein a water collecting groove having at least one first draining hole is formed at the water collecting portion of the bottom plate of the cooking chamber, a downwardly inclined portion for preventing a water dropped from the first draining hole from flowing into the motor is provided at the motor bracket below the first draining hole, and at least one second draining hole is formed at an end of the downwardly inclined portion of the motor bracket.

2. The microwave oven as claimed in claim 1, wherein the coupler is provided with a projection which extends into an inner portion of the water collecting groove.

3. The microwave oven as claimed in claim 1, wherein the motor bracket is formed at its predetermined portion, into which a motor shaft passes through, with an upwardly inclined portion.

4. The microwave oven as claimed in claim 2, wherein the motor bracket is formed at its predetermined portion, into which a motor shaft passes through, with an upwardly inclined portion.

* * * * *